US005491872A

United States Patent [19]

Tserng

[11] Patent Number: 5,491,872

[45] Date of Patent: Feb. 20, 1996

[54] HANDLE ASSEMBLY FOR CASE

[76] Inventor: Yueh-Chy Tserng, No. 26-21,, Shi She Juang, Shi She Li, Chang Hua, Taiwan

[21] Appl. No.: 402,832

[22] Filed: Mar. 13, 1995

[51] Int. Cl.[6] ..... A45C 13/26; A45C 13/28

[52] U.S. Cl. ..... 16/115; 190/115

[58] Field of Search ..... 16/112, 115; 190/115, 190/39; 280/304.5, 655, 47.315, 47.371; D8/306, 316

[56] References Cited

U.S. PATENT DOCUMENTS

| | | | |
|---|---|---|---|
| 4,828,081 | 5/1989 | Nordstrom et al. | 190/115 |
| 5,116,289 | 5/1992 | Pond et al. | 16/115 |
| 5,181,590 | 1/1993 | Carpenter et al. | 190/115 |
| 5,330,037 | 7/1994 | Wanh | 16/115 |
| 5,394,965 | 3/1995 | Kho | 16/115 |

*Primary Examiner*—Maurina T. Rachuba
*Assistant Examiner*—Christopher Kirkman
*Attorney, Agent, or Firm*—Charles E. Baxley

[57] ABSTRACT

A handle device includes a board having a groove laterally formed in the rear portion and having two holes formed in the middle portion and communicating with the groove. A pair of slots are formed in the front portion of the board and communicating with the holes. The slots each includes two end portions. A U-shaped handle includes a middle portion engaged in the groove and includes two legs extended through the holes and rotatably engaged in the slots. The slots of the board each includes a narrower middle portion so as to maintain the legs of the handle in either of the end portions of the slot.

2 Claims, 4 Drawing Sheets

HANDLE ASSEMBLY FOR CASE

BACKGROUND OF THE INVENTION

1. Field of the Invention

The present invention relates to a handle, and more particularly to a handle assembly for cases such as suitcases and baggages.

2. Description of the Prior Art

Typical handles for cases may be received and concealed within the baggages. However, a rather complicated configuration should be provided for receiving the handle and for allowing the handle to be pulled outward of the baggage.

The present invention has arisen to mitigate and/or obviate the afore-described disadvantages of the conventional handles for baggages.

SUMMARY OF THE INVENTION

The primary objective of the present invention is to provide a handle assembly for a case which includes a greatly simplified configuration that is excellent for manufacturing purposes and for operational purposes.

In accordance with one aspect of the invention, there is provided a handle assembly comprising a board including a rear portion having a groove laterally formed therein and including a middle portion having two holes formed therein and communicating with the groove, the board further including a front portion having a pair of slots formed therein and communicating with the holes, the slots each including a first end portion aligned with the holes and a second end portion in perpendicular to the first end portion, and a U-shaped handle including a middle portion engaged in the groove and including two legs extended through the holes and engaged in the slots, the legs being rotatable about the middle portion of the handle and rotatable from the first end portions of the slots to the second end portions, the legs including a free end portion having a hand grip secured thereto. The slots of the board each includes a narrower middle portion so as to maintain the legs of the handle in either the first end portions or the second end portions of the slot.

A panel is further secured to the board so as to form a pocket therebetween and includes a pair of first slits for engaging with the legs of the handle. The panel further includes a second slit formed therein so as to form an entrance for the pocket.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
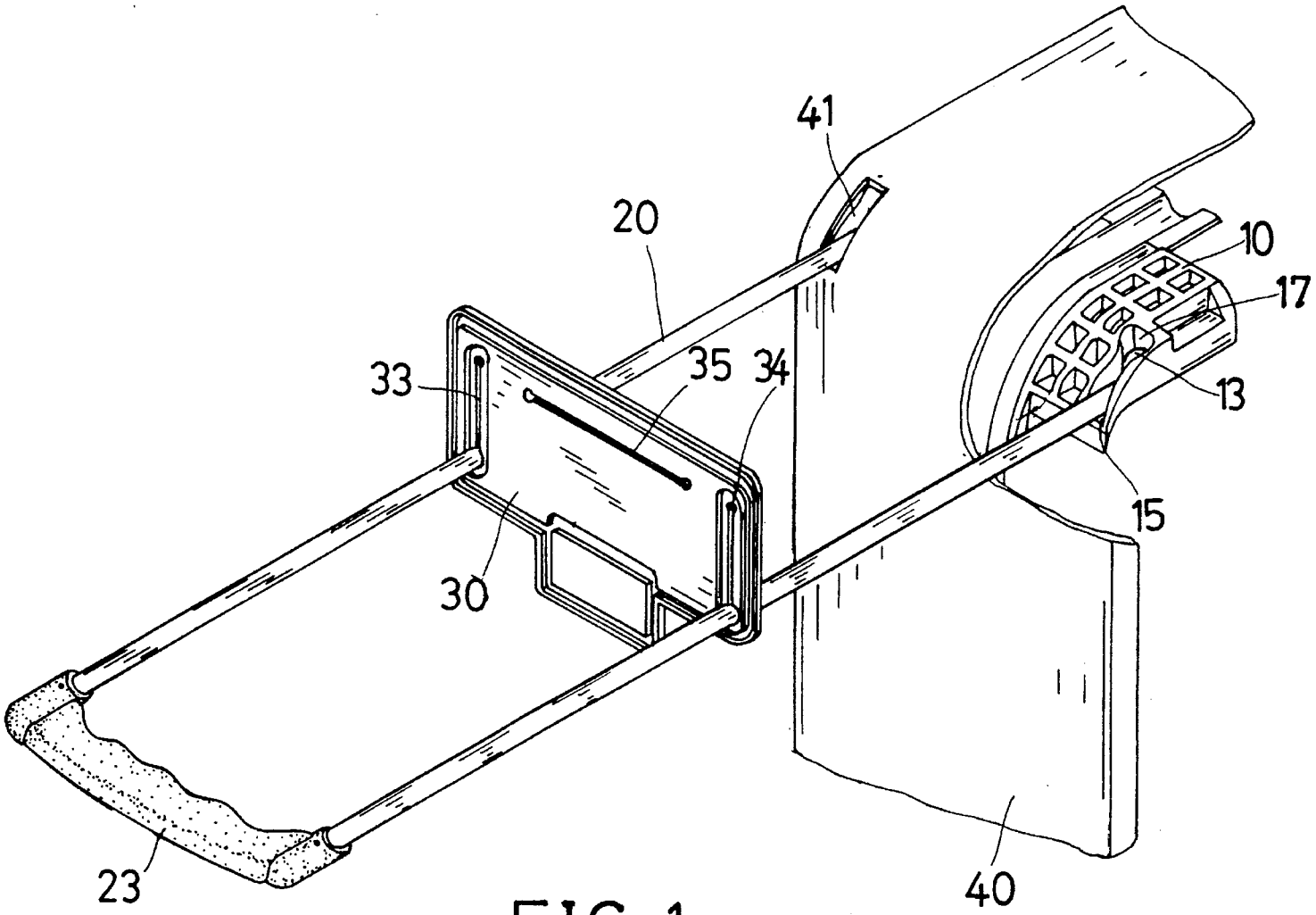
FIG. 1 is a perspective view of a handle assembly in accordance with the present invention.
Figure 2:
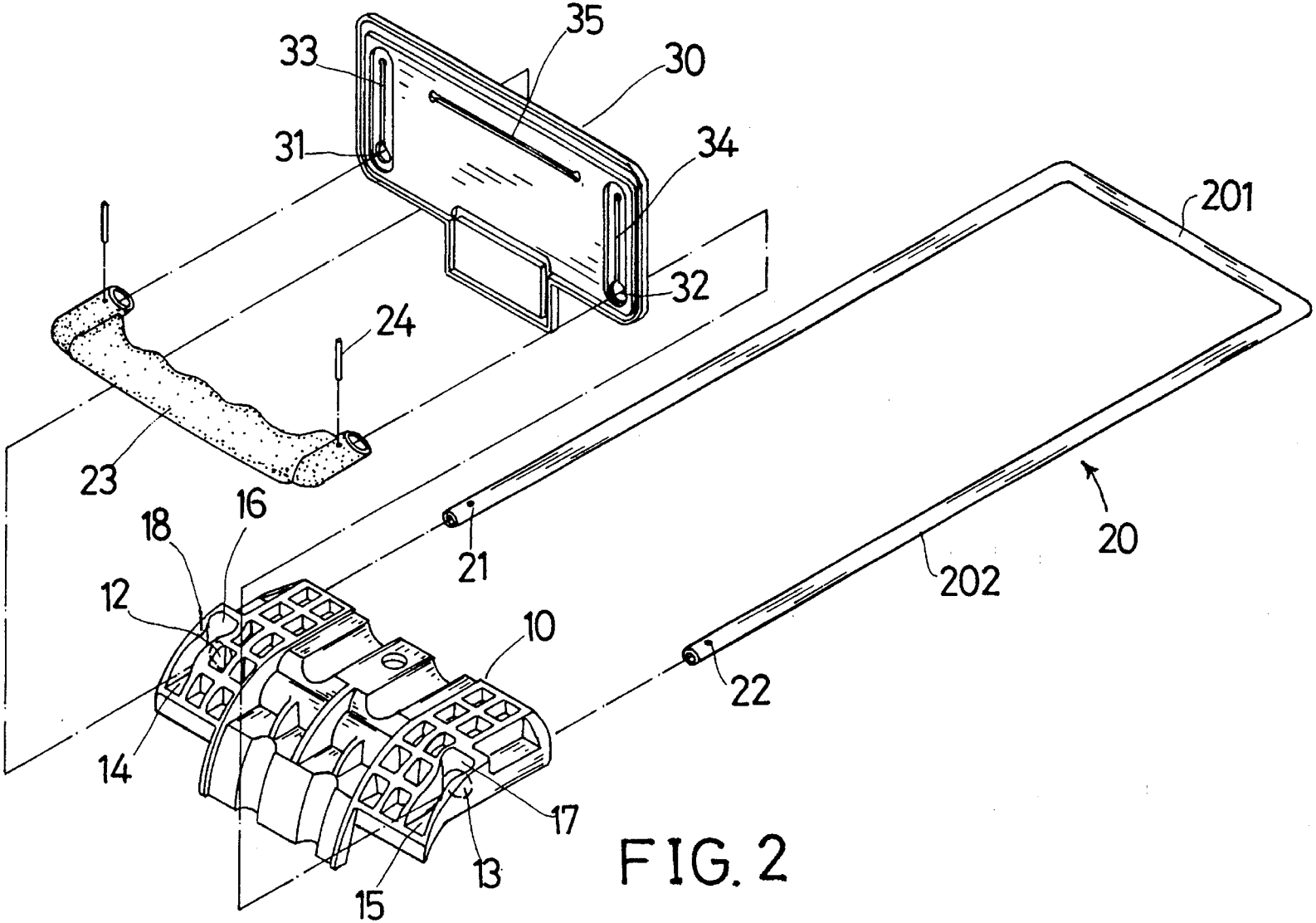
FIG. 2 is an exploded view of the handle assembly.
Figure 3:
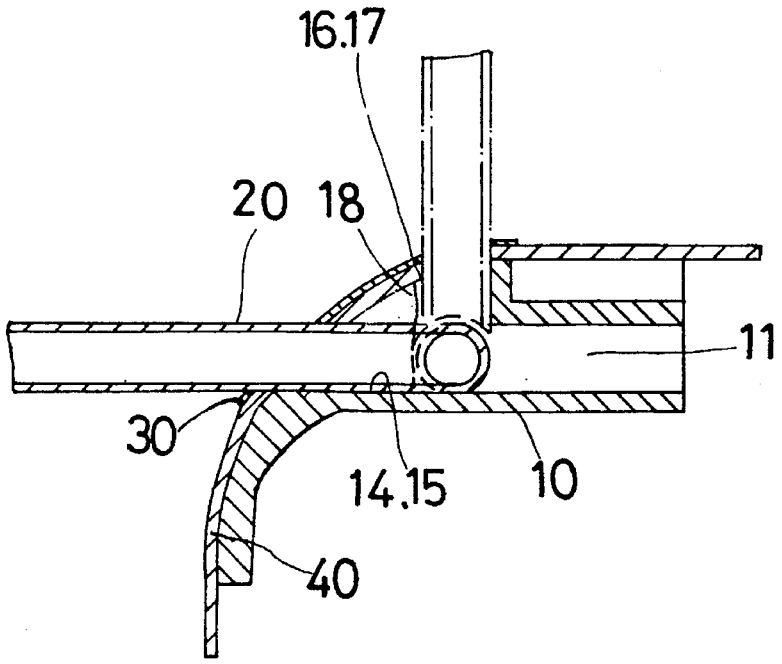
FIG. 3 is a cross sectional view taken along lines 3—3 of FIG. 4.

Referring to the drawings, and initially to FIGS. 1 to 3, a handle assembly in accordance with the present invention is provided for use in cases such as suitcases, baggages or bags and comprises a board 10 that is to be engaged in the corner area of a suitcase 40. The suitcase 40 includes two openings 41 formed therein.

The board 10 includes a groove 11 laterally formed in the rear portion (FIG. 3) and a pair of holes 13 formed in the middle portion and communicating with the groove 11. A U-shaped handle 20 includes a middle portion 201 engageable in the groove 11 and includes two legs 202 engaged through the holes 13. A pair of slots 18 formed in the front portion of the upper surface and communicating with the holes 13. The slots 18 each includes a first end portion 14, 15 aligned with the holes 13 and a second end portion 16, 17 in perpendicular to the groove 11 (FIG. 3) for supporting the legs 202 in a horizontal position and in a vertical position respectively, The slots 18 each includes a narrower middle portion so as to maintain the handle 20 in the horizontal position and in the vertical position. The free ends of the legs 202 each includes an aperture 21, 22 formed therein for engaging with fastening means 24 which may secure a hand grip 23 to the handle 20.

Figure 4:
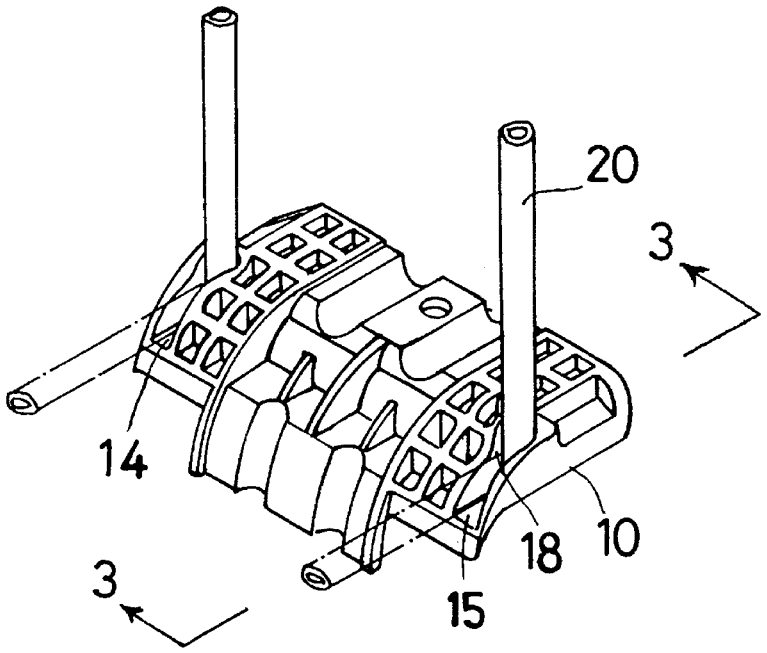
FIG. 4 is a partial perspective view illustrating the operation of the handle assembly.

In operation, as shown in FIGS. 3 and 4, the handle 20 may be pulled outward of the board 10 and may be rotated about the middle portion 201 thereof so as to engage with either of the end portions 14, 15, 16, 17 of the slots 18. When it is required to conceal the handle, it is only required to rotate the handle 20 to the horizontal position and to move the handle 20 inward the housing 10.

Figure 5:
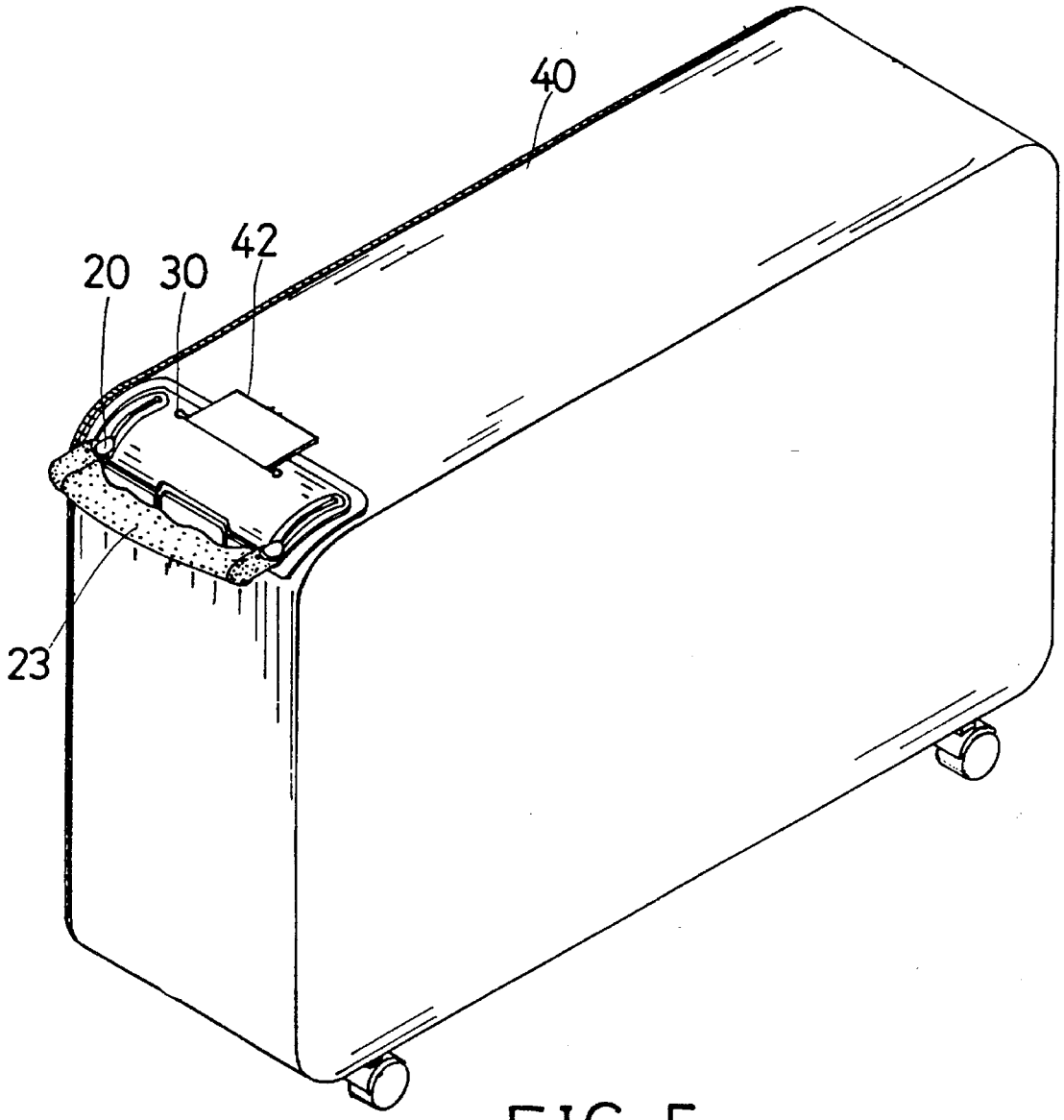
FIG. 5 is a perspective view showing the application of the handle assembly in a suitcase.

Referring next to FIG. 5 and again to FIGS. 1 and 2, a panel 30 is secured to the suitcase and to the board 10 and includes a pair of slits 33 formed therein and having punctures 31, 32 formed in the end portions for engaging with the legs 202 of the handle 20. The legs 202 may move along the slits 33 when the panel 30 is secured to the corner area of the suitcase 40. The panel 30 may further include a slit 35 formed therein so as to form an entrance into a pocket which is formed between the panel 30 and the suitcase 40 for engaging with a name card 42 or a tag.

Accordingly, the handle assembly in accordance with the present invention includes a greatly simplified configuration for concealing the handle. The handle may also be easily pulled outward of the case and may be easily maintained in either horizontal or vertical position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle assembly comprising:

a board including a rear portion having a groove laterally formed therein and including a middle portion having two holes formed therein and communicating with said groove, said board further including a front portion having a pair of slots formed therein and communicating with said holes, said slots each including a first end portion aligned with said holes and a second end portion perpendicular to said first end portion, and a U-shaped handle including a middle portion engaged in said groove and including two legs extended through said holes and engaged in said slots, said legs being rotatable about said middle portion of said handle and rotatable from said first end portions of said slots to said second end portions when said middle portion of said handle is engaged in said groove, said legs including a free end portion having a hand grip secured thereto, said slots of said board each including a narrower middle portion so as to maintain said legs of said handle in either said first end portions or said second end portions of said slot.

2. A handle assembly according to claim 1 further comprising a panel secured to said board so as to form a pocket therebetween and including a pair of first slits for engaging with said legs of said handle, said panel further including a second slit formed therein so as to form an entrance for said pocket.

* * * * *